US007493722B2

(12) United States Patent
Howe et al.

(10) Patent No.: US 7,493,722 B2
(45) Date of Patent: Feb. 24, 2009

(54) TACTICAL ILLUMINATOR

(75) Inventors: Alan T. Howe, Merrimack, NH (US); Timothy R. Loring, Bedford, NH (US)

(73) Assignee: Insight Technology Incorporated, Londonderry, NH (US)

( * ) Notice: Subject to any disclaimer, the term of this patent is extended or adjusted under 35 U.S.C. 154(b) by 9 days.

(21) Appl. No.: 11/558,109

(22) Filed: Nov. 9, 2006

(65) Prior Publication Data

US 2007/0227056 A1 Oct. 4, 2007

Related U.S. Application Data

(60) Provisional application No. 60/737,569, filed on Nov. 17, 2005.

(51) Int. Cl.
*F41G 1/00* (2006.01)
*F41G 1/34* (2006.01)

(52) U.S. Cl. ..... 42/146; 362/110

(58) Field of Classification Search ..... 42/114–115, 42/117, 146; 362/110
See application file for complete search history.

(56) References Cited

U.S. PATENT DOCUMENTS 6,574,901 B1 * 6/2003 Solinsky et al. ..... 42/146
7,117,624 B2 * 10/2006 Kim ..... 42/85
7,188,978 B2 * 3/2007 Sharrah et al. ..... 362/396
D542,446 S * 5/2007 DiCarlo et al. ..... D26/38
7,310,903 B2 * 12/2007 Kim ..... 42/90
2005/0217162 A1 * 10/2005 Matthews et al. ..... 42/146
2005/0257415 A1 * 11/2005 Solinsky et al. ..... 42/146
2007/0068060 A1 * 3/2007 Kim ..... 42/146
2007/0074444 A1 * 4/2007 Kim ..... 42/146
2007/0253207 A1 * 11/2007 Coombs et al. ..... 362/418
2008/0040965 A1 * 2/2008 Solinsky et al. ..... 42/90

OTHER PUBLICATIONS

Surefire Model X200A/X200B Operator's Manual, 2 pages, Rev. May 1, 2005 On/Off switching of the product disclosed in this instruction manual is believed by applicant to be representative of prior art.
Streamlight TLR-1/TLR-2 Operating Instructions, 6 pages, Copyright Jan. 2006.
Glock Tactical Light, Instructions for Use, 5 pages, Copyright May 2005 On/Off switching of the product disclosed in this instruction manual is believed by applicant to be representative of prior art.
Insight Technology MX3, Manual, 24 pages, Rev. Jul 2003.
Laser Devices LAS/TAC 2, MIL-SPEC Tactical Light Manual, 2 pages On/Off switching of the product disclosed in this instruction manual is believed by applicant to be representative of prior art.

* cited by examiner

*Primary Examiner*—Bret Hayes
*Assistant Examiner*—Michael D David

(57) ABSTRACT

A plurality of actuators allow a gun operator to control the on/off status of an illuminator attached to a weapon in the area forward of the trigger guard. The actuators are spaced to allow them to extend rearwardly on opposite sides of the trigger guard. "Up" turns the light emitter on and keeps it on or allows it to turn on as long as the actuator is actuated, regardless of which side of the trigger guard the actuator is actuated.

17 Claims, 4 Drawing Sheets

TACTICAL ILLUMINATOR

CROSS REFERENCE TO RELATED APPLICATIONS

The present application claims the benefit of Provisional Patent Application Ser. No. 60/737,569, filed Nov. 17, 2005, the entire disclosure of which is incorporated herein by reference in its entirety.

BACKGROUND OF THE INVENTION

The need to be able to effectively see a target and aim a weapon in the direction of the target is well recognized. Tactical illuminators to facilitate illuminating a target and aiming a weapon, especially under low light conditions, are known. Tactical illuminators typically have an incandescent lamp or light emitting diode (LED) to provide general illumination of an area or person of interest. The output is typically a white light capable of projecting 40 to 150 lumens, although higher output lights are also known. Some tactical illuminators have a laser for providing point of impact indication.

The tactical illuminator may be attached to a weapon, for example a handgun, long gun, or shotgun, in a variety of different ways. Some tactical illuminators are secured to a handgun having a set of rails located under the barrel, in an area forward of the trigger guard, and some tactical illuminators are secured to the trigger guard.

These tactical illuminators typically have one or more actuators to turn the light and/or laser on or off located on the ends of these devices. Some tactical illuminators for use with handguns have actuators that straddle the trigger guard to allow the operator to control the light from either side of the weapon. These actuators are not independent. Actuating one actuator on one side of the trigger guard causes the other actuator on the other side of the trigger guard to also move. In some tactical illuminators, rotating the actuator on the right side of the trigger guard upward (about a horizontal axis) causes the actuator on the left side of the trigger guard to also rotate upward. In other tactical illuminators, rotating the actuator on the right side of the trigger guard counterclockwise (about a longitudinal axis) causes the actuator on the left side of the trigger guard to also rotate counterclockwise. Placement of fingers on the trigger or non-trigger hand can impede movement of the actuator on an opposite side of the gun.

BRIEF DESCRIPTION OF THE DRAWINGS

Features and advantages of the present invention are set forth by description of embodiments consistent therewith, which description should be considered along with the accompanying drawings, wherein.

DETAILED DESCRIPTION OF THE EMBODIMENTS

Figure 1:
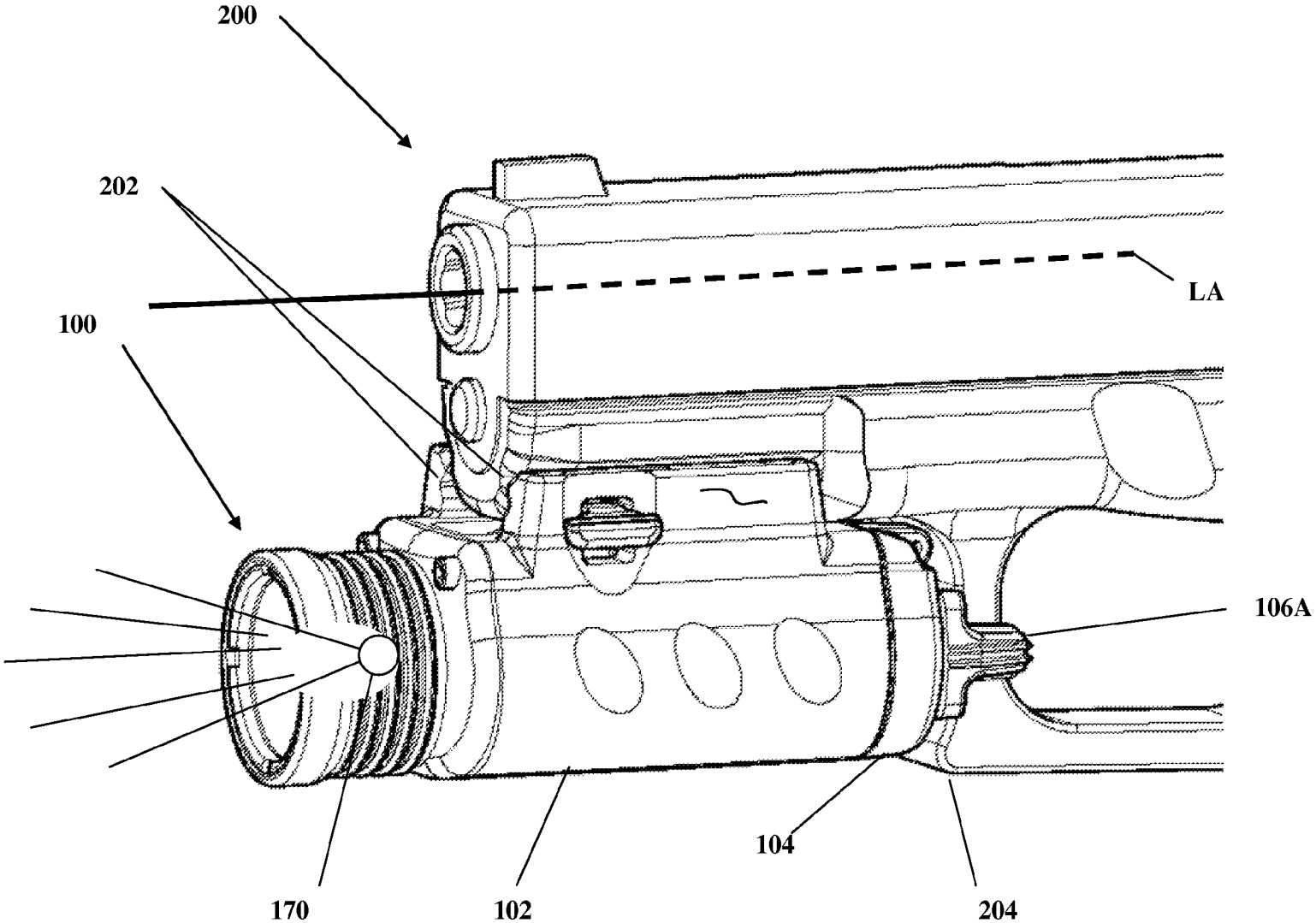
FIG. 1 is a perspective view of a tactical illuminator consistent with one embodiment of the invention mounted to a weapon.
Figure 2:
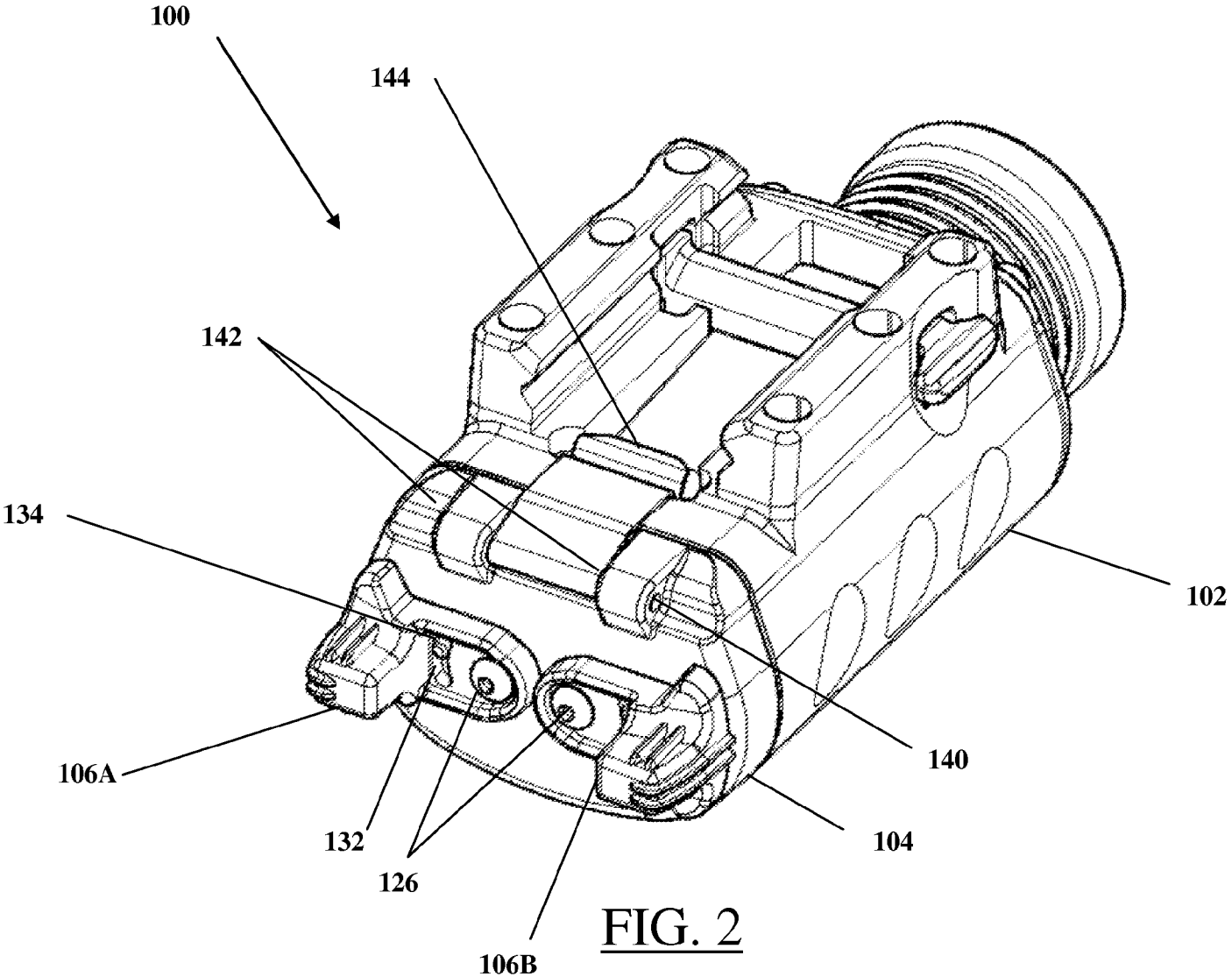
FIG. 2 is a rear perspective view of the tactical illuminator of FIG. 1.

With reference to FIGS. 1 and 2, there is depicted a tactical illuminator 100 consistent with one embodiment of the invention mountable to a weapon 200. For convenience, the description that follows describes the tactical illuminator as a device generally used to cast light upon a target area or a portion thereof. The light may extend outwardly from a first end of the tactical illuminator 100 from a light emitter 170 and be generally aligned parallel with a longitudinal axis LA of the weapon 200. The light may illuminate a large area (e.g. a flashlight) or may be concentrated on a small area (e.g. laser pointer).

The weapon 200 may be a handgun (as shown), a long gun, or shotgun. A set of rails 202 may be disposed in an area forward of a trigger guard 204 extending generally parallel to the longitudinal axis LA of the weapon 200. The tactical illuminator 100 may be coupled to rails 202 in a variety of different ways. For example, the tactical illuminator may utilize the spring-biased mechanism disclosed in issued U.S. Pat. No. 6,574,901, or a conventional rail or trigger guard clamping mechanism.

One or more actuators for controlling the on/off status of the light emitter 170 may extend outwardly from a second end of the tactical illuminator 100. A first actuator 106A may be spaced from a second actuator 106B (see FIG. 3) by a distance sufficient to allow the trigger guard 204 to extend therebetween. The actuators may be part of a tail cap assembly 104 that may be coupled to the housing 102 with a retainer 144. The retainer 144 may be secured to bosses 142 in the tail cap assembly 104 by a retainer pin 140 that may be rotatable about an axis perpendicular to the longitudinal axis of the housing 102. Alternatively, a retainer may be secured to the housing by a retainer pin.

Figure 3:
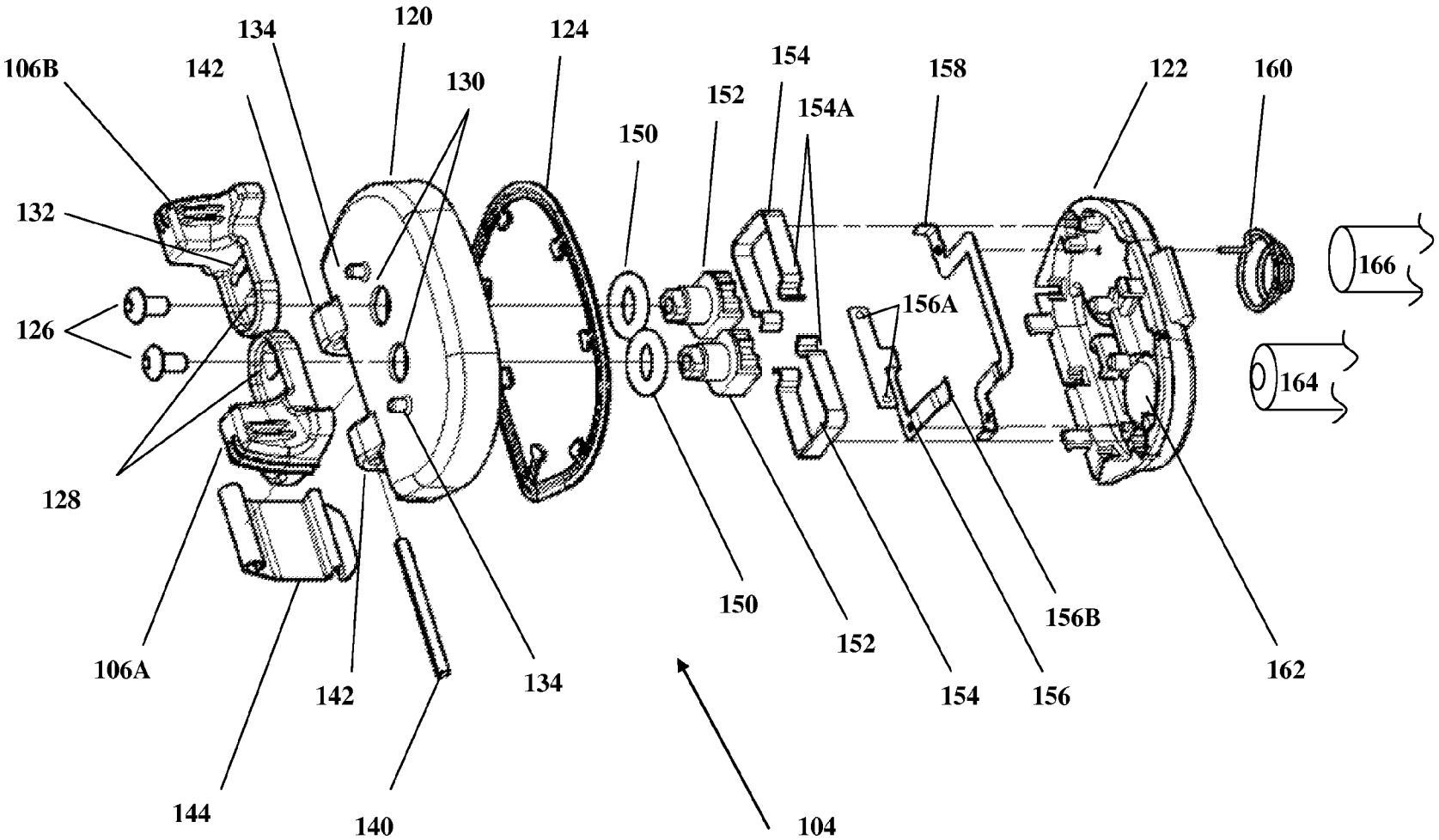
FIG. 3 is an exploded perspective view of a tail cap assembly of the tactical illuminator of FIG. 1.

FIG. 3 is an exploded perspective view of a tail cap assembly consistent with one embodiment of the invention. A first housing portion 120 and a second housing portion 122 may be coupled together with a gasket 124 and O rings 150 to form a water-tight tail cap assembly 104. First actuator 106A and second actuator 106B may be pivotably coupled to the first housing portion 120 by fasteners 126 extending through openings 128 in the first and second actuators 106A, 106B and openings 130 in the first housing portion 120. The first housing portion 120 may have protrusions 134 that extend through openings 132 in the first and second actuators 106A, 106B to limit the travel of the first and second actuators 106A, 106B.

First and second actuators 106A, 106B may be coupled to cam members 152 to urge portions 154A of conductors 154 into electrical contact with portions 156A of electrical conductor 156. The cam members 152 may have cammed surfaces on opposing sides to provide momentary and constant-on operation and provide tactile feel to actuators 106A, 106B. The end portion 156B of electrical conductor 156 may extend through an opening 162 in second housing portion 122 to provide an electrical connection to a first battery 164 disposed in the housing 102. Electrical conductor 158 may provide an electrical connection between conductors 154 and contact 160, which in turn provide an electrical connection to a second battery 166 disposed in the housing 102.

Figure 4:
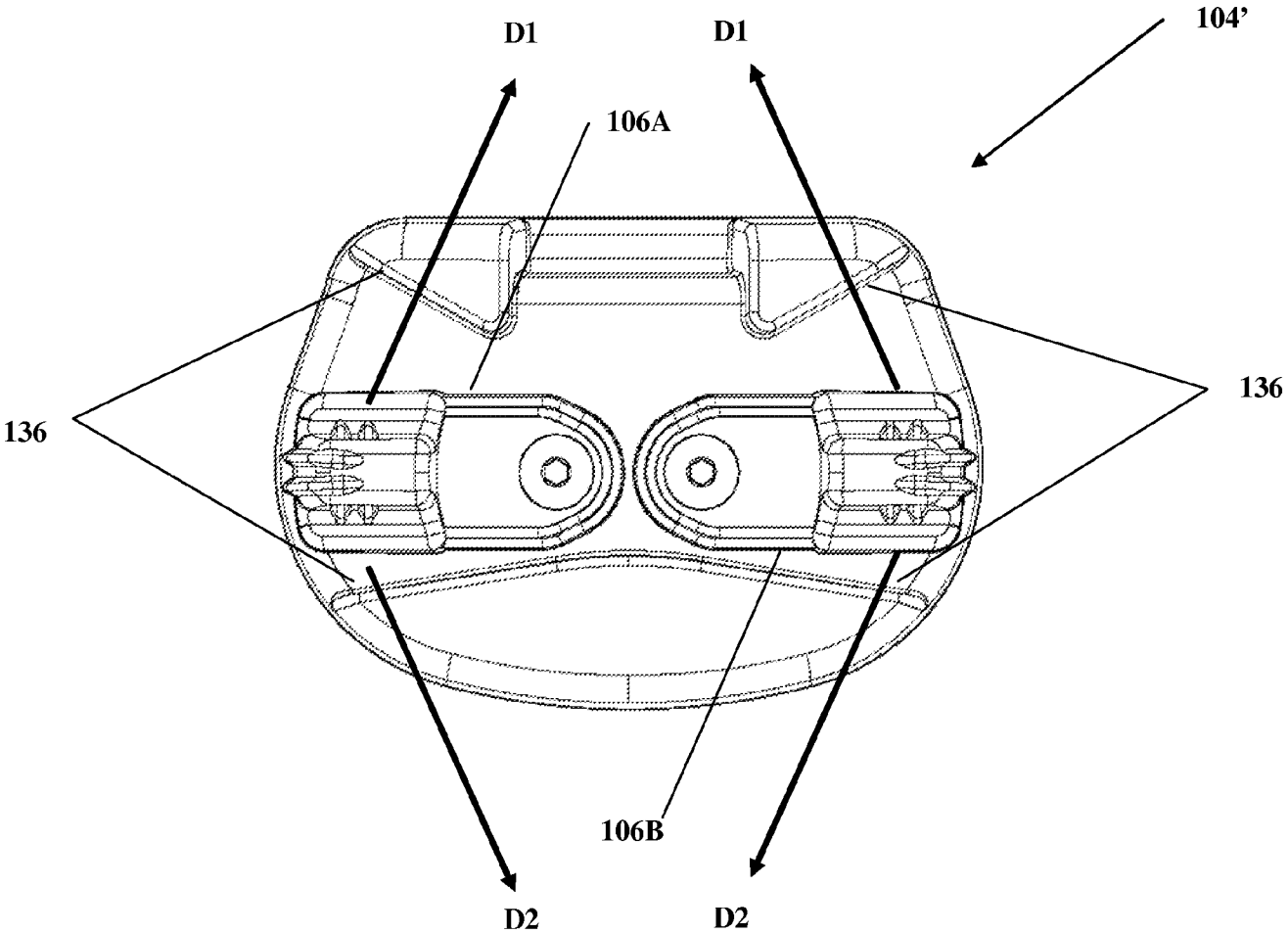
FIG. 4 is a rear view of a tap cap assembly consistent with a second embodiment of the invention.

FIG. 4 is a rear view of a tap cap assembly 104' consistent with a second embodiment of the invention. The rear tail cap assembly 104' may have protrusions 136 for limiting travel of the first and second actuators 106A, 106B.

It has been discovered that it is easier to train a peace officer if a tactical illuminator actuator(s) works the same, regardless of which hand the weapon is in. FIGS. 3 and 4 show that the first actuator 106A may be moveable in a first general direction D1 (upward, when the weapon is operated in its typical orientation, i.e. the trigger guard under the barrel) to cause the light emitter to turn on and stay on and moveable in a second general direction D2 (downward) to cause the light emitter to stay on as long as the actuator is actuated and turn off when released. Second actuator 106B may be moveable in the first general direction D1 to cause the light emitter to turn on and stay on and moveable in the second general direction D2 to cause the light emitter to turn on as long as the actuator is actuated and turn off when released. Clockwise rotation of the first actuator 106A may cause the light emitter 170 to turn on and stay on and counterclockwise rotation may cause the light emitter 170 to turn on as long as the actuator 106A is actuated. Counterclockwise rotation of the second actuator 106B may cause the light emitter 170 to turn on and stay on and clockwise rotation may cause the light emitter 170 to stay on as long as the actuator 106B is actuated. The correlation between the clockwise/counterclockwise movement of the actuators 106A, 106B and whether the light emitter 170 turns on and stays on may be changed without departing from the invention.

According to one aspect there is provided an illuminator for use with a weapon having a trigger guard. The illuminator may include a housing having a longitudinal axis, the housing at least partially enclosing a battery and supporting a first and a second movable actuator mechanically coupled to the housing. The first actuator moveable in a first general direction, independent of the second actuator, to cause a light emitter coupleable to the battery to turn on and stay on and moveable in a second general direction, independent of the second actuator, to cause the light emitter to turn on as long as the actuator is actuated, and the second actuator moveable in the first general direction, independent of the first actuator, to cause the light emitter to turn on and stay on and moveable in the second general direction, independent of the first actuator, to cause the light emitter to stay on as long as the actuator is actuated.

According to another aspect there is provided a tactical illuminator for use with a weapon having a trigger guard. The tactical illuminator may include a housing for at least partially enclosing a battery and supporting a first actuator rotatable about a first axis parallel to a longitudinal axis of the housing and a second actuator rotatable about a second axis parallel to the longitudinal axis of the housing. The first and second actuators configured to selectively control an on/off status of a light emitter coupleable to the battery. The first actuator actuatable from a first side of the trigger guard and the second actuator actuatable from a second side of the trigger guard, the second actuator being operable independent of the first actuator.

According to a yet another aspect there is provided a method of controlling a light emitter in a tactical flashlight. The method may include the steps of rotating a first actuator about a first axis parallel with a longitudinal axis of the tactical flashlight in a first general direction to cause the light emitter to turn on and stay on and rotating the first actuator about the first axis in a second general direction to cause the light emitter to turn on as long as the actuator is actuated. The method may further include the steps of rotating a second actuator about a second axis spaced from the first axis and parallel with the longitudinal axis in the first general direction to cause the light emitter to turn on and stay on and rotating the second actuator about the second axis in the second general direction to cause the light emitter to turn on as long as the actuator is actuated.

Although several embodiments of the present invention have been described in detail herein, the invention is not limited hereto. It will be appreciated by those having ordinary skill in the art that various modifications can be made without materially departing from the novel and advantageous teachings of the invention. Accordingly, the embodiments disclosed herein are by way of example. It is to be understood that the cope of the invention is not limited thereby.

We claim:

1. An illuminator for use with a weapon having a trigger guard, the illuminator comprising:

a housing at least partially enclosing a battery;

a first movable actuator mechanically coupled to the housing and actuatable from a first side of the trigger guard; and a second movable actuator coupled to the housing and actuatable from a second side of the trigger guard, the first actuator movable in a first general direction independent of the second actuator to cause a light emitter coupleable to the battery to turn on and stay on and moveable in a second and opposite general direction independent of the second actuator to cause the light emitter to turn on as long as the actuator is actuated by a user, and turn off when released, and the second actuator moveable in the first general direction independent of the first actuator to cause the light emitter to turn on and stay on and moveable in the second and opposite general direction independent of the first actuator to cause the light emitter to turn on as long as the actuator is actuated by a user, and turn off when released.

2. The illuminator of claim 1, wherein the second actuator is spaced from the first actuator by a distance sufficient to allow the trigger guard to extend therebetween.

3. The illuminator of claim 1, wherein the first actuator is pivotable about an axis parallel to a longitudinal axis of the housing.

4. The illuminator of claim 3, wherein rotation of the first actuator rotates a cam which in turn moves a portion of an electrical conductor into electrical contact with the battery.

5. The illuminator of claim 3, wherein the first general direction is upward and the second and opposite general direction is downward when the weapon is held with the barrel above the trigger guard.

6. The illuminator of claim 3, wherein the first actuator is rotatable clockwsie to cause the light emitter to turn on and stay on and rotatable counterclockwise to cause the light emitter to turn on as long as the actuator is actuated and off when released, and the second actuator is rotatable counterclockwise to cause the light emitter to turn on and stay on and rotatable clockwise to cause the light emitter to turn on as long as the actuator is actuated and off when released.

7. The illuminator of claim 3, wherein the first actuator and second actuators move in a plane generally perpendicular to the longitudinal axis of the housing.

8. The illuminator of claim 1, wherein movement of the first actuator completes an electrical connection between the battery and the light emitter.

9. The illuminator of claim 1, wherein the first and second actuators are coupled to the housing through a cap that is securable to the housing.

10. The illuminator of claim 9, further comprising a retainer pivotable about an axis generally perpendicular to the longitudinal axis for securing the cap to the housing.

11. The illuminator of claim 9, wherein the cap includes a protuberance for limiting travel of the actuator.

12. The illuminator of claim 1, wherein the first actuator may be actuated from a first side of a trigger guard, when the illuminator is coupled to a weapon, without causing movement of the second actuator and the second actuator may be actuated from a second side of the trigger guard without causing movement of the first actuator.

13. An illuminator for use with a weapon having a trigger guard, the illuminator comprising:

a housing for at least partially enclosing a battery;

a first actuator rotatable about a first axis parallel to a longitudinal axis of the housing, the first actuator configured to selectively control an on/off status of a light emitter coupleable to the battery, the first actuator actuatable from a first side of the trigger guard; and a second actuator rotatable about a second axis parallel to the longitudinal axis of the housing, the second actuator configured to selectively control the on/off status of the light emitter, the second actuator actuatable from a second side of the trigger guard, the second actuator being operable independent of the first actuator;

wherein the first actuator is rotatable in a first general direction to cause the light emitter to turn on and stay on and rotatable in a second general direction to cause the light emitter to turn on as long as the actuator is actuated by a user, and turn off when released, and the second actuator is rotatable in the first general direction to cause the light emitter to turn on and stay on and rotatable in the second general direction to cause the light emitter to turn on as long as the actuator is actuated by a user, and turn off when released.

14. The illuminator of claim 13, wherein the second actuator is spaced from the first actuator by a distance sufficient to allow the trigger guard to extend therebetween.

15. The illuminator of claim 13, wherein the first general direction is upward and the second general direction is downward when the weapon is held with the barrel above the trigger guard.

16. The illuminator of claim 13, wherein the first actuator is rotatable clockwsie to cause the light emitter to turn on and stay on and rotatable counterclockwise to cause the light emitter to turn on as long as the actuator is actuated, and the second actuator is rotatable counterclockwise to cause the light emitter to turn on and stay on and rotatable clockwise to cause the light emitter to turn on as long as the actuator is actuated.

17. An illuminator for use with a weapon having a trigger guard, the illuminator comprising:

a housing at least partially enclosing a battery;

a first movable actuator mechanically coupled to the housing and actuatable from a first side of the trigger guard; and a second movable actuator coupled to the housing and actuatable from a second side of the trigger guard, the first actuator rotatable in a first general direction independent of the second actuator to cause a light emitter coupleable to the battery to turn on and stay on and rotatable in a second general direction independent of the second actuator to cause the light emitter to turn on as long as the actuator is actuated by a user, and turn off when released, and the second actuator rotatable in the first general direction independent of the first actuator to cause the light emitter to turn on and stay on and rotatable in the second general direction independent of the first actuator to cause the light emitter to turn on as long as the actuator is actuated by a user, and turn off when released.

* * * * *